United States Patent [19]

Webb

[11] 4,311,109

[45] Jan. 19, 1982

[54] FAIRLEAD

[75] Inventor: Michael G. Webb, Wootton Bridge, England

[73] Assignee: The British Petroleum Company Limited, London, England

[21] Appl. No.: 122,609

[22] Filed: Feb. 19, 1980

[30] Foreign Application Priority Data

Mar. 6, 1979 [GB] United Kingdom ..... 07833/79

[51] Int. Cl.[3] ..... E02B 15/04

[52] U.S. Cl. ..... 114/220; 210/923; 405/69

[58] Field of Search ..... 114/218–220, 114/101; 405/68, 69; 210/923, 924; 254/190 R, 190 A, 190 B, 190 C, 190 D, 191

[56] References Cited

U.S. PATENT DOCUMENTS

| | | | |
|---|---|---|---|
| 4,112,689 | 9/1978 | Webb | 210/923 |
| 4,123,911 | 11/1978 | Finigan et al. | 210/923 |
| 4,244,819 | 1/1981 | Ballu | 210/923 |

*Primary Examiner*—Frank Sever

*Attorney, Agent, or Firm*—Morgan, Finnegan, Pine, Foley & Lee

[57] ABSTRACT

A rotatable fairlead suitable for use in the deployment, control and recovery of anti-pollution booms, comprises two end pieces (1 and 2), two pins, or rollers, 3 and 4, mounted between the end pieces and spaced sufficiently apart that a partially inflated boom may pass between the pins, means for rotating the said end pieces and pins through at least 270° and means for holding them at a given angle of rotation.

5 Claims, 4 Drawing Figures

FAIRLEAD

Figure 1:
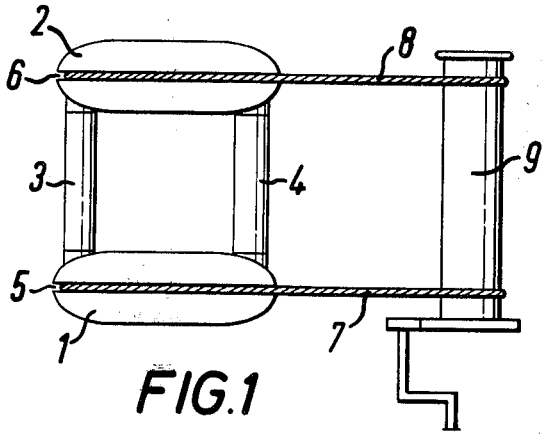

This invention relates to a rotatable fairlead suitable for use in the deployment, control and recovery of anti pollution booms.

When crude petroleum or petroleum products are transported there is a risk of accidental spillage or unauthorised discharge taking place. If this happens at sea or on inland waterways the water is liable to become polluted by oil. In recent years, several instances of pollution caused by collisions or groundings of tankers have occurred.

Many systems have been proposed for the containment of oil on the surface of water and many of them perform satisfactorily under suitable sea conditions. There is however the need to provide a robust system that can operate in rough sea conditions such as are frequently found in the North Sea and can at the same time be easily and rapidly deployed and then recovered at sea. There is a further need to provide a system for the control of oil on water that can be operated from existing vessels, and particularly from the various tug support vessels of the type that have been developed for use in support of the oil production platforms in the North Sea.

Our British patent specification No. 1554737 discloses and claims a method of deploying an inflatable, flexible, floating barrier comprising a continuous gas-inflatable gas chamber and continuous water-inflatable water chamber from a support vessel, which comprises securing a first end of the barrier to the vessel, connecting gas inflating means to said first end of the gas chamber and water inflating means to said first end of the water chamber and discharging the barrier progressively from the vessel while inflating at least the gas chamber so that the barrier does not sink, causing relative separation between the vessel and the discharged barrier so that the latter takes up a closed curved shape away from the vessel, passing the second end of the barrier to a second support vessel or an anchoring means, moving the barrier to its desired position and maintaining the gas and water inflation of the deployed barrier.

Further according to British Pat. No. 1554737 there is provided a method for the recovery of a deployed, inflated, flexible, floating barrier comprising a continuous gas inflatable gas chamber and a continuous water-inflatable water chamber, said barrier being secured to a support vessel at a first end which comprises bringing the second end of the barrier aboard the vessel over a driven roller which can pull the barrier aboard the vessel and cause its deflation, allowing gas and water to escape at the first end of the barrier and controlling the gas pressure in the gas chamber so that the barrier does not sink during the recovery operation.

During deployment from the first support vessel it may be desirable to reduce the rate of deployment of the boom or to halt deployment of the boom without risking its deflation.

During recovery of the boom it is preferred to compress the boom while hauling-in to force gas, usually air, from the inflatable gas chamber. If hauling-in is stopped for any reason, it is desirable to prevent air from surging back into the recovered section.

We have now devised a rotatable fairlead which permits such operations to be carried out simply, effectively and cheaply.

Conventionally a fairlead is a device for keeping a rope or cable in place so that it may run clear. Such devices are commonly used, for example, on sailing vessels, and simply comprise on inverted U-shape of plastic or metal, the open end of which is attached to the vessel. However, such fairleads cannot control the rate at which the rope passes through and have no means of stopping and holding the rope.

Thus according to the present invention, a rotatable fairlead, suitable for use in the deployment, control and recovery of inflatable anti pollution booms, comprises two end pieces, two pins mounted between the end pieces and spaced apart, so that a boom may pass between the pins, means for rotating said end pieces and pins through at least 270° and means for holding them at a given angle of rotation.

During recovery a boom is likely to have oil adhereing to its surface, which will make it slippery and so the boom will easily pass between the pins. However, in order to facilitate the deployment of clean booms, a fairlead may have rollers in place of the fixed pins.

Preferably the fairlead is circular in form with the pins or rollers mounted near the circumference and diametrically opposed to one another.

The distance between the pins or rollers should be sufficient to allow a partially inflated boom to pass between them, and is preferably at least half of the diameter of the largest chamber of a fully inflated boom.

The length of each pin or roller is preferably greater than 1.5 times the diameter of the largest chamber of the boom.

The end pieces may be elliptical in cross-section.

The fairlead is rotated about an axis parallel to the axes of the pins, or rollers. Preferably it is rotated about an axis at the centre of a diameter joining the two pins, or rollers.

The means for rotating the fairlead and for locking it at a given angle of rotation may, for example, be a ratchet wheel, which may be manually operated or may be power driven.

The ratchet wheel may be mounted directly onto the fairlead, but for ease of operation, it is preferably remote from the fairlead. A remote ratchet wheel may rotate the fairlead by means of wires, fixed at one end to a drum associated with the ratchet wheel and fixed at the other end to the end pieces of the fairlead. The end pieces may have circumferential grooves in which the wires are positioned.

With conventional fairleads, a rope may be loaded into the fairlead by feeding one end between the pins, and a boom may be loaded into a fairlead according to the present invention in the same manner. Alternatively, one of the end pieces may be removable, or may be rotatably mounted on one of the pins so that it may be swung away from the second pin. In either of these embodiments, the boom may be passed between the open ends of the pins and the end piece replaced to keep the boom within the fairlead.

Figure 2:
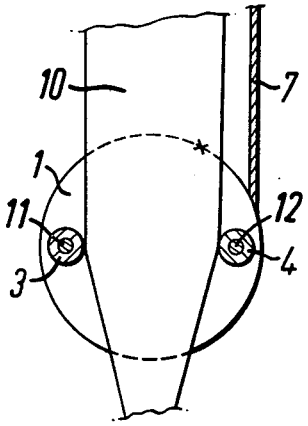
Figure 3:
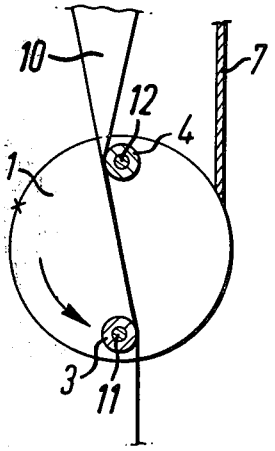
Figure 4:
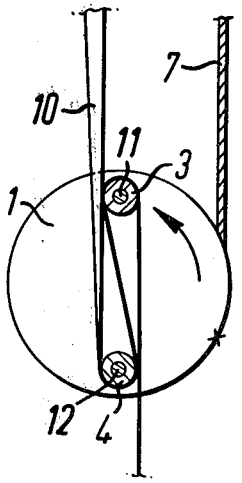

The invention is illustrated with reference to FIGS. 1–4 of the accompanying drawings wherein FIG. 1 is a diagram of the fairlead and FIGS. 2–4 are sections of the fairlead in various operating positions.

The embodiment illustrated comprises two circular discs 1 and 2, elliptical in end cross-section and joined by two rollers 3 and 4.

The two rollers 3 and 4 are mounted on axes 11 and 12, near the circumference of the end pieces 1 and 2 and diametrically opposed to one another.

Each of the end pieces 1 and 2 has a circumferential groove 5 and 6 into which a wire 7 and 8 may pass. One end of each wire 7 and 8 is attached to a rotatable drum 9, and the other end of each wire 7 and 8 is fixed into one of the grooves 5 and 6, in such a manner that the wire is in contact with the groove for at least three quarters of the circumferential length of the groove, when the fairlead is in the position for deploying a boom quickly, as shown in FIG. 2.

In FIGS. 2–4 the "X" on the circumference of the end piece 1 indicates the point at which the wire 7 is fixed in the groove.

In FIG. 2 the fairlead is deploying a boom 10 quickly. As may be seen, the boom 10 passes through the fairlead with little if any restriction.

In FIG. 3 the fairlead is deploying the boom 10 slowly. In this case the boom 10 passes under one roller 4 and over the other 3, thus causing some restriction. This position is achieved by rotating the fairlead 90° in an anti-clockwise direction from the position in FIG. 2. By taking up the wires 7 and 8 onto the drum 9, the fairlead is rotated about an axis which is parallel to the axes of the rollers 3 and 4 and positioned centrally between them.

The drum 9 may be rotated by a simple hand ratchet.

In FIG. 4 deployment has stopped and the boom 10 is doubled back upon itself around the rollers 3 and 4 thus effectively shutting it off. This position is achieved by rotating the drum 9 so that more of the wires 7 and 8 are taken up onto the drum 9, thus rotating the fairlead through a further 180° in an anti-clockwise direction from the position shown in FIG. 3.

The haul of the boom 10 tends to rotate the fairlead to the position shown in FIG. 2 and therefore by paying out the wires from the drum 9 the fairlead may be rotated in a clockwise direction from its position in FIG. 4 to the position shown in FIG. 2.

The boom 10 is loaded into the fairlead by passing one end between the rollers 3 and 4.

I claim:

1. A rotatable fairlead comprising means for the deployment, control and recovery of an inflatable anti-pollution boom, including two end pieces, two pins mounted between said end pieces and spaced apart so that said boom may pass between the pins, means for rotating said end pieces and pins through at least 270° and means for holding said end pieces and pins at a given angle of rotation.

2. A fairlead according to claim 1 in which rollers are used in place of the pins.

3. A fairlead according to either of claims 1 or 2 in which the end pieces are circular and the pins, or rollers, are mounted near the circumference of the end pieces and are mounted diametrically opposed to one another.

4. A fairlead according claim 1 in which the means for rotation and the means for holding is a ratchet wheel.

5. A fairlead according to claim 4 wherein the ratchet wheel is remote from the fairlead, has a drum associated with it and wires fixed to the drum and to the end pieces, said wires being positioned in circumferential grooves in the end pieces.

* * * * *